United States Patent [19]

Yuhas et al.

[11] Patent Number: 5,006,766

[45] Date of Patent: Apr. 9, 1991

[54] WINDOW OPERATOR FOR MANUALLY OR ELECTRICALLY MOTORIZED ACTUATION OF A MECHANICAL WINDOW DRIVE SYSTEM

[75] Inventors: Ralph G. Yuhas; William H. Birmingham, both of Helena, Mont.

[73] Assignee: Rolscreen Company, Pella, Iowa

[21] Appl. No.: 393,130

[22] Filed: Aug. 14, 1989

[51] Int. Cl.[5] ..... E05F 15/00

[52] U.S. Cl. ..... 318/53; 49/139; 74/625

[58] Field of Search ..... 74/625; 49/139–144; 318/54, 266, 16, 53, 66, 76, 446, 483; 73/861.41

[56] References Cited

U.S. PATENT DOCUMENTS

| | | | |
|---|---|---|---|
| 2,350,957 | 6/1944 | Rappl | 49/139 |
| 3,177,367 | 4/1965 | Brown | 49/139 |
| 3,750,491 | 8/1973 | Herrmann | 74/625 |
| 4,085,629 | 4/1978 | Fogarollo | 74/625 |
| 4,210,277 | 7/1980 | Kolt | 49/340 |
| 4,367,660 | 1/1983 | Becker et al. | 74/625 |
| 4,464,651 | 8/1984 | Duhame | 74/141 X |
| 4,481,735 | 11/1984 | Jentoft et al. | 49/139 X |
| 4,544,865 | 10/1985 | Sharp | 318/53 |
| 4,544,866 | 10/1985 | Clemmons et al. | 318/54 |
| 4,553,656 | 11/1985 | Lense | 49/139 X |

*Primary Examiner*—William M. Shoop, Jr.
*Assistant Examiner*—A. Jonathan Wysocki
*Attorney, Agent, or Firm*—Zarley McKee, Thomte, Voorhees & Sease

[57] ABSTRACT

A motorized window operator for opening and closing a window having a mechanical drive system including a rotatable drive axle. A housing contains a motor which is in operative engagement with a gear train having an output gear. The output gear is engageable with an engagement means mounted upon the drive axle of the window. For engaging the output gear train with the engagement means, operation of the motor will rotate the drive axle to either open or close the window according to desire. The gear train is dissengageable from the engagement means which at the same time dissengages power to the motor. The drive axle can then be manually operated.

19 Claims, 6 Drawing Sheets

MPD7506
U1
+5V-14
GND-28
CONTROLLER
P5-3
P5-2
P5-1
P5-0
P1-3
P1-2
P1-1
P1-0
P4-3
P4-2
P4-1
P4-0
P0-0
P0-3/X1
X2
CL2
CL1
RST
INH 23
OPEN 22
CLOSE 21
RAIN 20
FS1 1
FS2 27
FS4 26
DIR 25
RESET
CIRCUITRY
VN2222LL
IN4148
AUX-SR30.5
C474KAT
2N390
TL431
REGULATOR
+V(+5V)
+E
+15V
GND
LOGIC
GND
REF
INH
IN
INH
OUT
OPEN
CLOSE
RAIN
100K
10K
1.2K
2.2K
4.7K
3.3K
1K
820
10.0K
3.16
K
15.0
K
3.09
K
3.32K
.01
.1
1.

WINDOW OPERATOR FOR MANUALLY OR ELECTRICALLY MOTORIZED ACTUATION OF A MECHANICAL WINDOW DRIVE SYSTEM

BACKGROUND OF THE INVENTION

1. Field of the Invention

The present invention relates to motorized operation of windows, and in particular, with respect to motorized operators for window, skylights, and other fenestration devices, and still more particularly, with respect to those types of devices which are opened or closed by manually operated cranks or handles.

2. Problems in the Art

There are many types of fenestration products such as windows, skylights, doors, etc. Many windows and skylights, for example, are operated by manually turning an axle or spindle, utilizing a crank or handle. Linkage or other hardware between the handle and the windows or skylights translates the cranking action into opening or closing of the window.

As it is well known, such manual operation can at times be difficult or laborious. This is particularly true if a large number of rotations of the crank is needed for wide opening of the window, or if there is sticking or other mechanical resistance to the movement of the window. Also, when numerous windows need to be opened or closed, the problem is magnified and can be extremely time consuming.

Attempts have been made to create a motorized window operator which would improve upon the above mentioned problems. For example, Lense U.S. Pat. No. 4,553,656, Clemmons et.al., U.S. Pat. No. 4,544,866, and Sharp U.S. Pat. No. 4,544,865, all relate to powered actuators or operators for windows.

Motorized operation of windows and other fenestration devices present a variety of problems. Attempts such as those by Lense, Clemmons and Sharp attempt to solve or overcome these difficulties or problems.

Present attempts can be bulky or large which necessarily take up space, can block some of the view, or protrude a distance from the window or the framework. They also generally require substantial electrical power which can be costly, and which can be dangerous.

Present attempts at window operators also have room for improvement in efficiency, economy, and precision. A further problem involves whether windows utilizing present attempts for motorized operation can be easily manually operated, if needed or desired.

Therefore it can be seen that there are problems and deficiencies in the art with regard to motorized window operators and actuators.

It is therefore the principal object to the present invention to solve, overcome, or improve over the problems and deficiencies in the art.

It is further object of the present invention to provide a motorized window operator which is of minimal size and obtrusiveness when installed with respect to a window, yet provides efficient full power and performance to efficiently and economically operate the window.

It is a still further object of the present invention to provide a motorized window operator which efficiently operates at low electrical power, and includes features which diminishes any safety risks.

Another object to the present invention is to provide a motorized operator which utilizes gearing which is efficient yet can provide enough mechanical power for overcoming most sticking, friction, or mechanical restriction for opening and closing windows.

Another option of the present invention is to provide a motorized actuator which is economical to operate.

A further object to the present invention is to provide a motorized window operator which is not difficult to install, maintain, or service.

It is a still further object of the present invention to provide a motorized actuator which facilitates easy manual override operation in case of power failure or other problems.

Another object to the present invention is to provide a motorized window actuator which accurately and reliably monitors opening and closing of the window.

It is a still further object of the present invention to provide a motorized window actuator which has the capability of acting autonomously upon sensing of certain environmental conditions such as rain, smoke, temperature, etc.

These and other object, features, and advantages of the present invention will become more apparent with reference to the accompanying specification and claims.

SUMMARY OF THE INVENTION

The present invention consists of a motorized window operator for motorized opening and closing of windows, and other fenestration devices, reliably, efficiently, and economically. An electric motor is contained within minimally sized and unobtrusive housing. The gear train is employed to provide sufficient torque at slow speeds for rotating the axle or spindle while opening and closing of the window, yet do so in an efficient and economical manner.

An engagement means is utilized to interface the motor and gear train with the spindle or axle of the window. The engagement means or device can be adapted to engage a variety of different types of spindles or axles to allow some universality for the motorized window operator. The invention also can utilize means for monitoring the rotation of the axle or spindle and engagement means to keep an accurate reading of the position of the window. This can be utilized in assuring accuracy and reliability for the full closing and opening of the window.

The invention has options, features and advantages which include the ability for the body or housing of the motorized window operator to be pivoted or articulated to move the gear train away from engagement with the engagement means. By using a locking mechanism, the housing can then be rotated, or otherwise moved to manually rotate the engagement means, and thus the spindle or axle of the window to manually operate the window.

Other possible features of the invention include automatic power disconnect when utilizing the motorized operator in a manual mode, easy and reliable connection to an electrical power source, and operation in conjunction with sensing elements such as rain, smoke, temperature, or wind sensors which could automatically control opening and closing of the windows.

DETAILED DESCRIPTION OF THE PREFERRED EMBODIMENT

Figure 1:
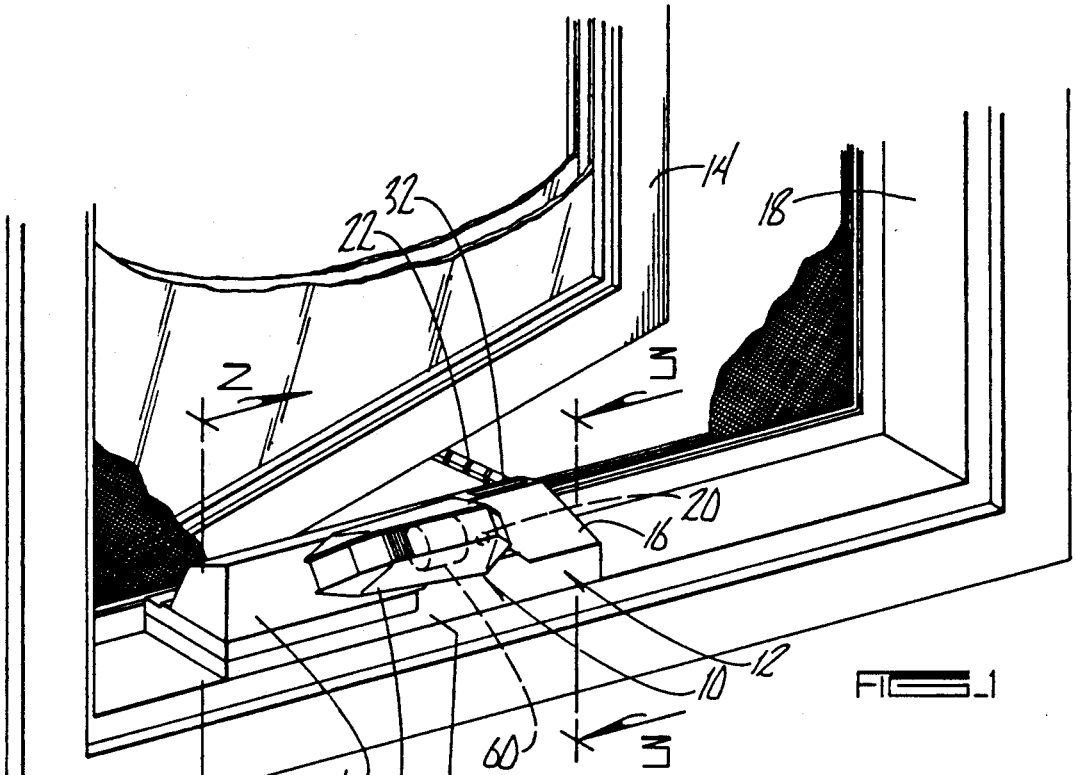
FIG. 1 is a partial perspective view of one embodiment of the invention in operable position with respect to a window and window hardware. Electronic control circuitry is also schematically shown.

With reference to the drawings, a preferred embodiment of the present invention will now be described. Reference numerals will be used for identify components in the drawing. Like reference numerals will be used for like parts in all of the drawings, except when otherwise noted.

The present invention allows motorized operation of a window which is normally opened or closed by rotation of a crank or handle which is attached to a rotary spindle or axle on the window hardware. For purposes of the present description, the term "window" will mean a variety of fenestration devices which includes windows, skylights, and the like.

With particular reference to FIG. 1, a motorized window operator 10 is shown in operative position with respect to the mechanical hardware 12 for opening and closing a window 14.

Mechanical hardware 12 includes a housing 16 secured to window frame 18. Housing 16 contains a rotary spindle or axle 20 (See FIG. 3), and related gearing (not shown) to convert rotation of spindle 20 to cause movement of linkage 22 which would open or close window 14.

Normally, a crank or handle would be attached to spindle 20. The person would utilize the handle or crank to get mechanical leverage to rotate spindle 20 to open or close window 14 as desired. The handle or crank is removed from mechanical hardware 12 to allow motorized window operator 10 to be operatively connected.

FIG. 1 also shows that in the embodiment of motorized window operator 10, a power base 24 is also attached to housing 16 of mechanical hardware 12. Power base 24 serves to contain control circuitry (See FIG. 2) for motorized window operator 10, and also provide a power junction to a conventional electrical power source.

As can be seen in FIG. 1 motorized window operator 10 is, in this preferred embodiment, basically of an elongated shape including a stylized and aesthetically pleasing housing 26. Both housing 26 and power base 24 integrate unobtrusively, and with minimal protrusion from, mechanical hardware 12, and window 14 and window frame 18 generally.

FIG. 1 also schematically depicts optional features for motorized window operator 10. Electrical power from electrical power source 28 can be controlled from a power control unit 30 which would send the electrical signals which instruct operation of motorized window operator 10. Power control unit 30 can be such as is disclosed and claimed in co-pending, commonly-owned application Ser. No. 234,199, by Kraft, Eberhardt, and Cannon, entitled Electrical Power and Control Means and Method, which is incorporated by reference herein.

A variety of sensors could be operatively connected to the control circuitry of motorized window operator 10 and power base 24. For example, a rain sensor 32 could be positioned so as to send a signal instructing window 14 to close upon sensing of moisture. Similarly wind sensors, temperature sensors, smoke sensors, etc, could be utilized for automatic control of motorized window operator 10 upon occurrence of some sensed event.

Figure 2:
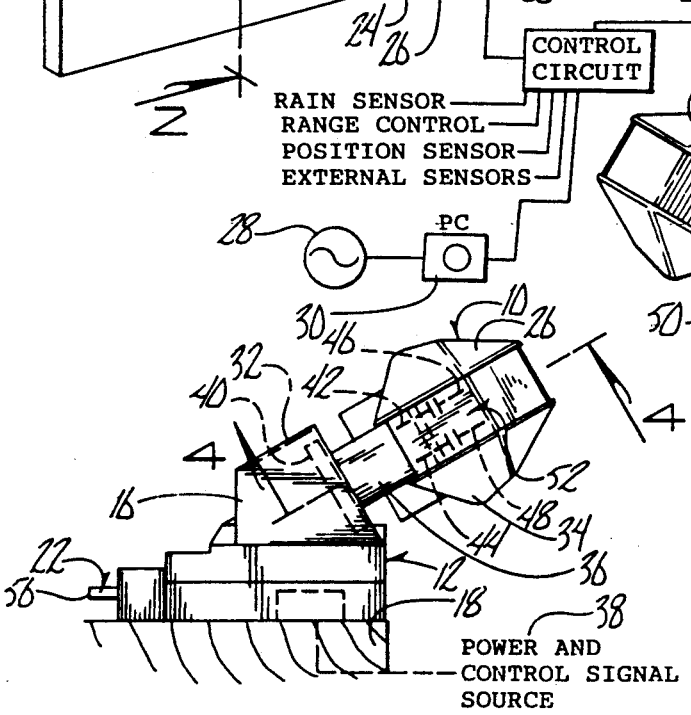
FIG. 2 is an end elevated view taken along line 2—2 of FIG. 1.
Figure 3:
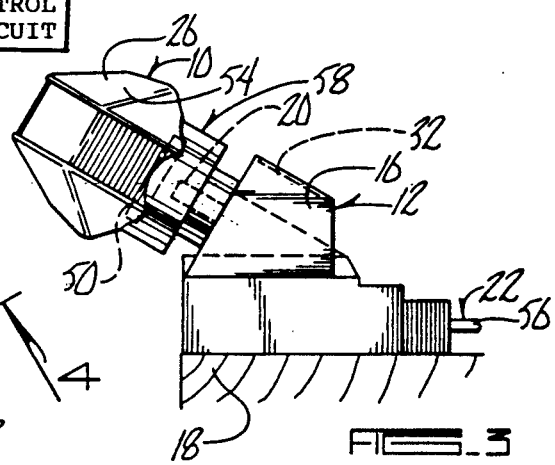
FIG. 3 is an opposite end elevational view taken along line 3—3 of FIG. 1.

FIGS. 2 and 3 show in more detail the orientation and features of the invention. In FIG. 2, back end 34 of housing 26 of motorized window operator 10 is shown with its association to power base 24. Power base 24 includes a post 36 which extends upwardly and outwardly. An electrical signal from power control signal source 38 is introduced into power base 24 which encloses control circuitry 40. The power and control signal is then channeled through electrical contacts 42 and 44 which extend through post 36. Back end 34 of motorized window operator 10 includes reception contacts 46 and 48 (See FIGS. 4 and 5), so that when back end 34 is brought into contact with post 36, the power and control signal is communicated to motorized window operator 10.

FIG. 3 shows, by hidden lines, a transfer pivot pin 50. Pivot pin 50 is positioned towards the opposite end from back end 34 of motorized window operator 10 and allows pivoting of operator 10 so that back end 34 can be pivoted away from and towards post 36. A latching mechanism 52 (See FIGS. 4 and 5) is utilized to release and secure back end 34 to post 36.

FIG. 2 also shows by hidden lines the position for rain sensor 32, if desired. This facing surface of power base 24 is angled so as to be optimum exposed to the exterior of window frame 18. It is then utilized to position rain sensor 32 to monitor for rain.

FIG. 3 depicts front end 54 of housing 26 of motorized window operator 10. From this view, the rotary spindle or axle 20 of mechanical hardware 12 for window 14 can be seen. For this particular mechanical hardware 12, rotation of spindle 20 is converted by gearing (not shown) to cause a type of chain link extension to extend from housing. Other types of mechanical hardware can be utilized for this purpose, such as is known in the art.

Spindle 20 extends angularly outwardly and upwardly from housing 16 of mechanical hardware 12. Normally it is splined or has radial teeth which can be engaged by a handle or crank to allow it to be manually rotated. In the preferred embodiment, an engagement member 58 extending out of housing 26 of motorized window operator 10 includes structure which allows motorized window operator 10 to grasp spindle 20. Engagement member 58 is rotatable within housing 26 of motorized window operator 10 according to operation of motor 60 (See FIG. 4) within housing 26. Therefore, FIGS. 2 and 3 show that motorized window operator 10 is mounted at back end 34 by latching mechanism 52 to post 36 of power base 24. Front end 24 is removably secured to rotary spindle 20 of mechanical hardware 12 of window 14 by engagement member 58. Thus, the power and control signals are sent to motorized window operator 10 causing motor 60 (See FIG. 4 and 5) to cause rotation of engagement member 58, which in turns causes rotation of spindle 20 achieving opening and closing of window 14.

Figure 4:
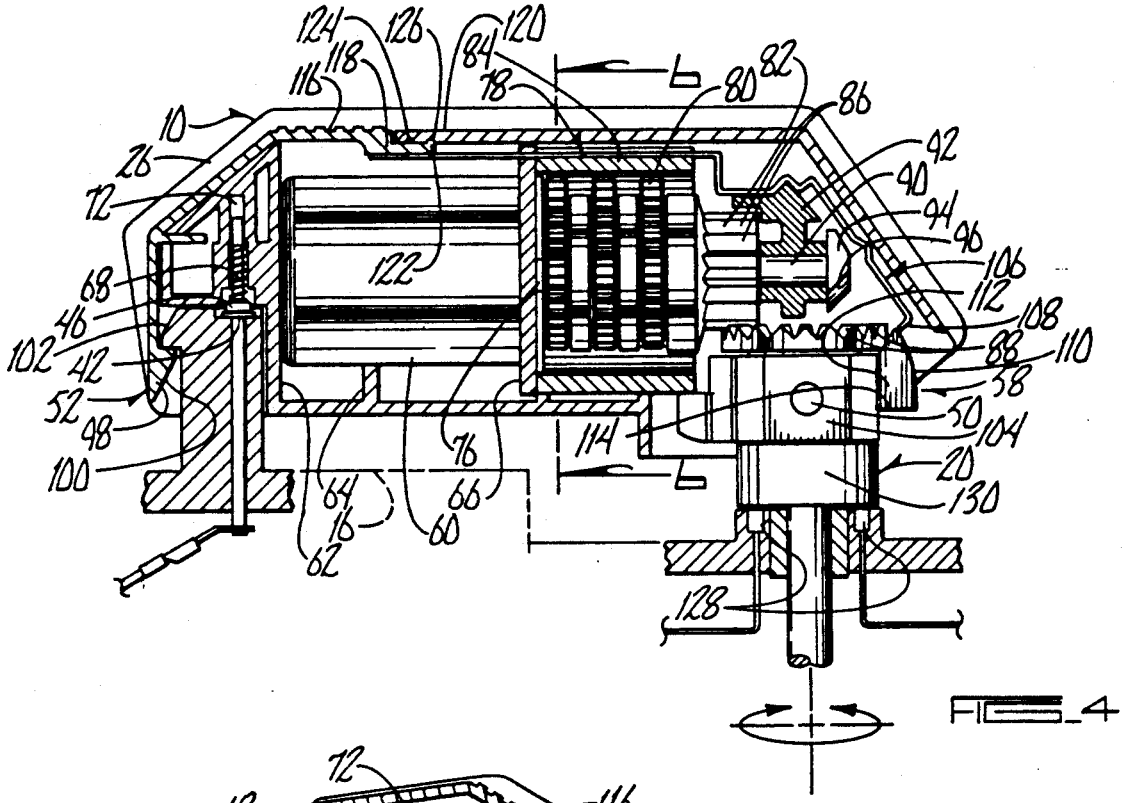
FIG. 4 is sectioned view taken along lines 4—4 FIG. 2 showing the invention in position for closing and opening of the window by operation of the motor.

FIG. 4 depicts with particularity the preferred embodiment of the interior of motorized window operator 10. Motor 60 is mounted along the longitudinal axis of housing 26, and is held rigidly in place by interior wall 62, 64, and 66. As can be seen, reception contacts 46 and 48 are spring loaded by springs 68 and 70 within "T" shaped bores 72 and 74. Springs 68 and 70 bias reception contacts 46 and 48 to contact electrical contacts 42 and 44 of power base 24. Reception contacts 46 and 48 are electrically communicated to motor 60 by means well known to the art, such as wires, cables, etc.

The output shaft 76 of motor 60 extends into operative connection to gear train 78. Gear train 78, in the preferred embodiment, consists of a plurality of epicyclic gears which reduce the high speed, high torque motor 60 output to high torque, slow speed at output gear 82.

Gear train 78 is contained within gearbox 84, one side of which is interior wall 66. As can be seen in FIG. 4, output gear 82 has teeth 86 which match and engage teeth 88 of engagement member number 58. Rotation of output gear 82 thus causes translational rotation of engagement member number 58. As previously described, engagement member 58 is, by means well known in the art, removably attached to rotary spindle or axle 20 of window 14. Therefore, rotation of engagement member 58 causes concurrent and proportional rotation of spindle 20, which then opens or closes window 14 according to direction of spindle 20.

It can also be seen in FIG. 4 that a rigid rod 90 extends through the center of output gear 82 outwardly therefrom. Rod 90 does not rotate and is rigidly mounted to supporting structure for gear train 78. Rod 90 is held in position by bracket 92 which is secured within housing 26 of motorized window operator 10.

At the outer end of rod 90 is a head member 94 which includes a tooth 96. Tooth 96 is pointed downwardly and is sized accordingly that it can engage a space between two teeth 88 of engagement member 58.

FIG. 4 additionally depicts other features of the preferred embodiment of the invention. Latching mechanism 52 can comprise a resilient latch 98 having a lip 100 which can be flexed outwardly and then released inwardly to catch and abut against flange 102 of post 36 of power base 24, when motorized window operator 10 is in the position shown in FIG. 4. Latching mechanism 52 can be made of plastic or any other resilient material.

FIG. 4 also shows particularly the location of transverse pivot pin 50 which is fixed in yoke 104 through which is rotatively journaled engagement member 58. Transverse pivot pin 50 extends to the opposite side of housing 26 of motorized window operator 10 and allows it to pivot between positions shown in FIG. 4 and in the position shown in FIG. 5, upon the release of latching mechanism 52.

Figure 5:
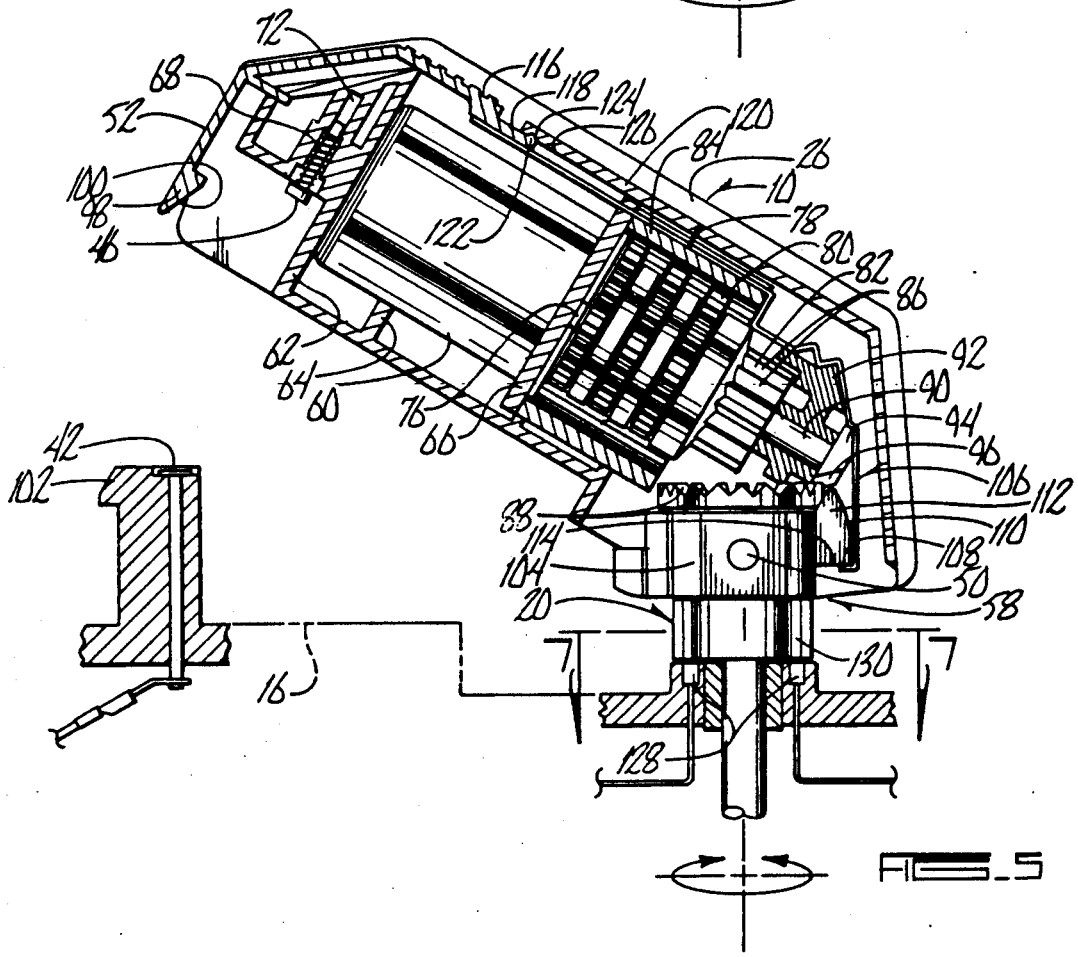
FIG. 5 is sectioned view, the same as FIG. 4 except that the motorized operator is shown in a tilted position whereby the invention can be operated in a manual mode overriding the motorized mode.

As can be seen in FIG. 5, tooth 96 of head member 94 of rod 90 engages the teeth 88 of engagement member 58 when window operator 10 is pivoted upwardly to the position shown in FIG. 5. A spring latch 106 having a forward lip 108, slides down convex surface 110 of member 112 until it catches on bottom edge 114 of member 112. This serves to lock motorized window operator 10 in the upward position shown in FIG. 5.

It can further be seen that in the preferred embodiment, spring latch 106 extends rearwardly and is attached to latching mechanism 52. Latching mechanism 52 has an end 116 opposite to its latch 98 end, which has an arm 118 which is slidable under wall 120 of housing 26. Arm 118 has a raised ridge 122 which is movable into either of slots of 124 or 126 on the inner surface of wall 120. The resiliency of spring latch 106 biases arm 118 with ridge 122 up against the inner side of wall 120.

When motorized window operator 10 is latched down against power base 24, as shown in FIG. 4, raised ridge 122 seats in slot 126. Lift 108 of spring latch 106 is released and simply rests along convex surface 110 of member 112. In this position, motorized window operator 10 receives power through power base 24 to motor 60. The output gear 82 from gear train 78 is meshed with gear on engagement member 58. Tooth 96 of head member 94 is out of engagement with engagement member 58. Motorized window operator 10 is thus locked into position to operate window 14 electrically.

On the other hand, as shown in FIG. 5, when latch 98 of latching mechanism 52 is pulled away from power base 24 to release motorized window operator 10 from power base 24, such action releases raised ridge 122 from slot 126 allowing it to slide back to slot 124. As motorized window operator 110 is tilted upwardly, lip 100 of latch 98 moves across convex surface 110 of member 112 and latches along bottom edge 114. Because raised ridge 122 is held in slot 124, motorized window operator 10 is releaseably locked into the upper position.

It is to be understood that when locked in the upward position, tooth 96 engages gear of engagement member 58. Housing 26 of motorized window operator 10 is pivotally secured to yoke 24, which is in turn rotatable around engagement member 58. Any rotational movement of motorized window operator 10 around the axes of rotary spindle 20 of window 14, will cause rotation of engagement member 58 and thus rotary spindle 20. This allows the window to be manually operated; either for closing or opening. It is to be noted that release of operator 10 from power base 24 cuts off all electrical power to operator 10, which contributes to safe operation in a manual mode.

When it is desired to return operator 10 to its position shown in FIG. 4, latching mechanism 52 simply needs to be pulled away from housing 26, which would release raised edge 122 from slot 124 and allow it to be slid to slot 126. This would release lip 108 from the bottom edge 114 of member 112, allowing operator 10 to be pivoted back downwardly and latched to power base 24.

Thus, the general operation of motorized window operator 10 can be seen. It is to be understood that the preferred embodiment can further include means for monitoring the exact rotational position of rotary spindle 20. Such information can then be used to pass to a control circuitry system to be used in the control of window 14.

For example, as shown in FIGS. 4 and 5, sensing means 128 can be positioned on opposite sides of rotary spindle 20 of window 14. Collar 130, could be rigidly attached to rotary spindle 20 and contain an indicator means (not shown) which can be sensed by sensing means 128. The number of rotations of the indicator means can then be monitored by sensing means 128 to provide position information. By utilizing two sensing means 128, direction of rotation can be derived.

Figure 6:
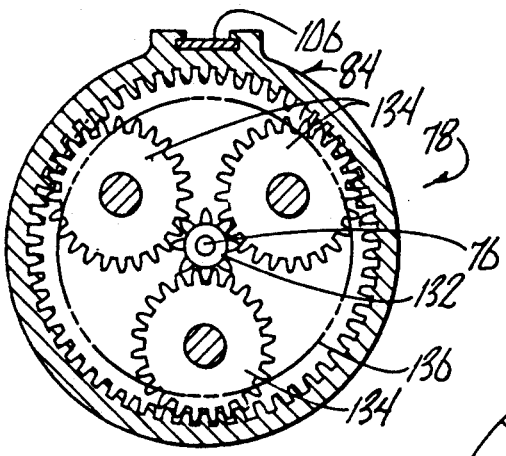
FIG. 6 is a sectional view taken along line 6—6 of FIG. 4.

FIG. 6 depicts a sectional view of one portion of the epicyclic gear train 78 used in preferred embodiment of the invention of motorized window operator 10. It can be seen that a plurality of spur gears are driven off of the central gear 132. Because motor 60 is high speed and high torque, the high speed of the rotation of central gear 132 would be reduced by the three spur gears 134, and further reduced by transferring rotational speed and power to ring gear 136. By having successive stages of such gearing, the high torque high speed motor rotation can be converted into high torque, low speed turning which is needed for operation of window 14. These types of gear arrangements are well known within the art.

Figure 7:
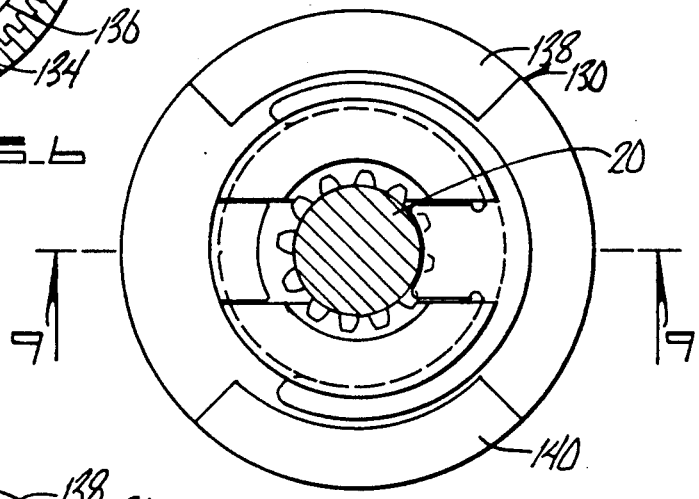
FIG. 7 is a sectioned view taken along line 7—7 of FIG. 5.
Figure 9:
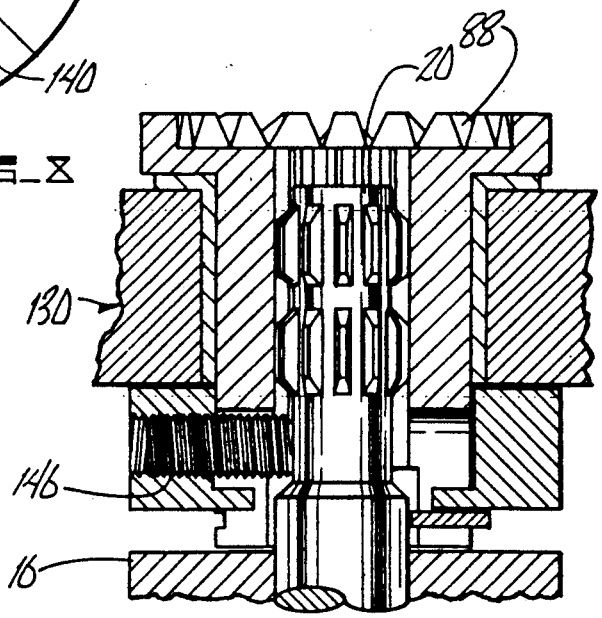
FIG. 9 is a sectional view taken along line 9—9 of FIG. 7.

FIGS. 7 & 9 depict specifically one embodiment of a sensing means 128. In this embodiment, collar 130 contains first and second magnets 138 and 140. As stated before, these magnets rotate with rotary spindle 20. Thus, rotation of spindle 20 would allow a sensing means 128 to pick up how many rotations of spindle 28 occur and the direction of the rotation. This can be converted into electrical signals which in turn can be used to allow a control circuitry to know exactly where the window is at all times.

Figure 8:
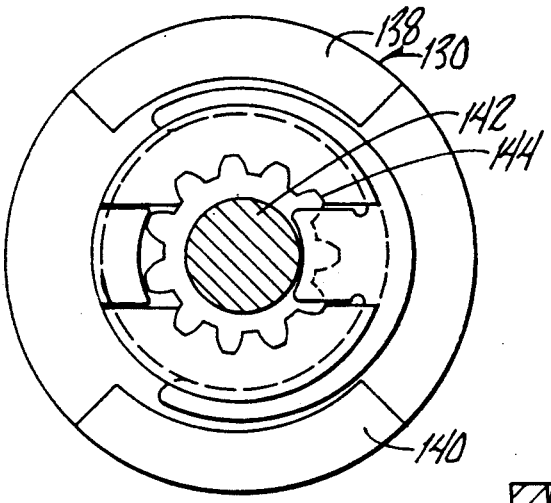
FIG. 8 is a similar view to FIG. 7, except showing a different spindle or axle for a different type of window drive hardware.

FIG. 8 simply shows that engagement member 58 and collar 130 can be applied to different types of rotary spindles. In this case rotary spindle 142 has fewer splines 144 than rotary spindle 20 of FIG. 7. It is also wider in total diameter. Thus the invention can be utilized with different types of windows, 114 and mechanical hardware 12.

FIG. 9 also shows how collar 130 could be secured to rotary spindle 20. A set screw 146 can be extended to hold collar 30 against rotary spindle 20.

Figure 10:
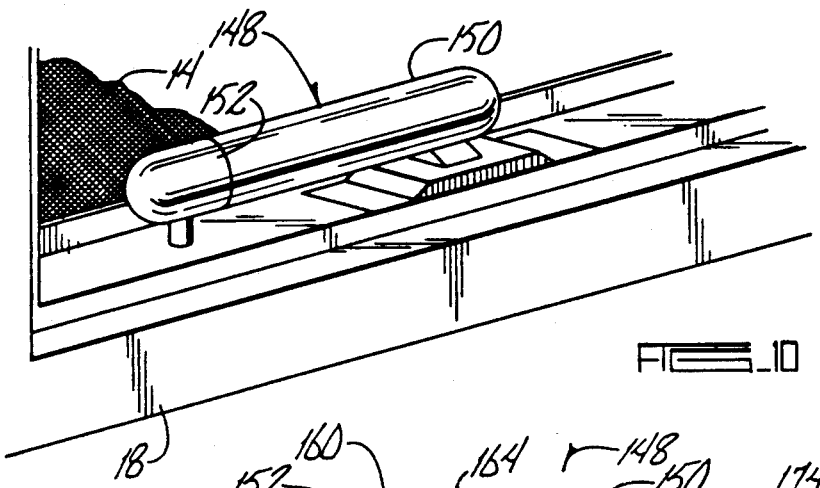
FIG. 10 is a perspective view of an alternative embodiment of the invention shown in an operative position with respect to a window and window operating hardware.
Figure 11:
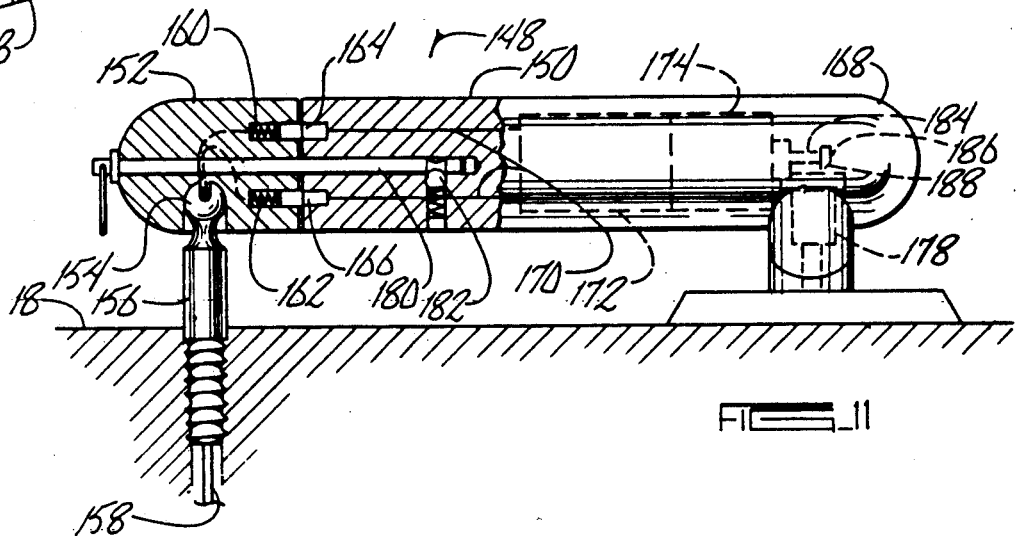
FIG. 11 is a partial sectional elevational view of the embodiment of FIG. 10.

FIGS. 10 and 11 show an alternative embodiment to motorized window operator 10. Motorized window operator 148 operates on generally the same principals as motorized window operator 10 previously described. It differs in two major respects. First, it can be seen that the housing 150 of operator 148 is somewhat different, being slender, rounded and elongated. Secondly, the power connection differs slightly from embodiment 10. In embodiment 148, rear portion 152 is suspended on ball joint 154 of post 156. Electrical conduit 158 passes through post 156 into the interior of the rear portion of 152 where it is distributed to spring loaded contacts 160 and 162. Mating reception contacts 164 and 166 are aligned in front portion 168 of motorized window operator 148. Conduit 170 then supplies electrical power to motor 172, gear train 174 and engagement member 178.

A locking pin 180 is inserted through a bore, along basically the longitudinal axis of embodiment 148, through rear portion 152 into front portion 168. A spring loaded ball 182 serves to provide releasible locking of locking pin 180, as shown in FIG. 11, to secure front and rear portions 168 and 152 in that position. Embodiment would then be in position to operate the opening and closing of the window.

If manual control is desired, pin 180 would be removed from portion 168 which could then be pivoted away from rear portion 152, and then tilted upwardly or otherwise operated so that rod 184 with head member 186 and tooth 188 could lock into engagement member 178 to allow manual rotation of rotary spindle of axle 20 of window 14 similarly to embodiment 10.

Figure 12:
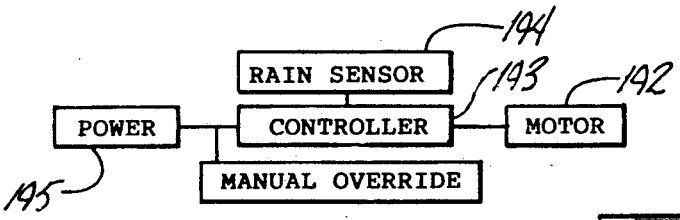
FIG. 12 is a block schematic diagram of operation of the invention.
Figure 12A:
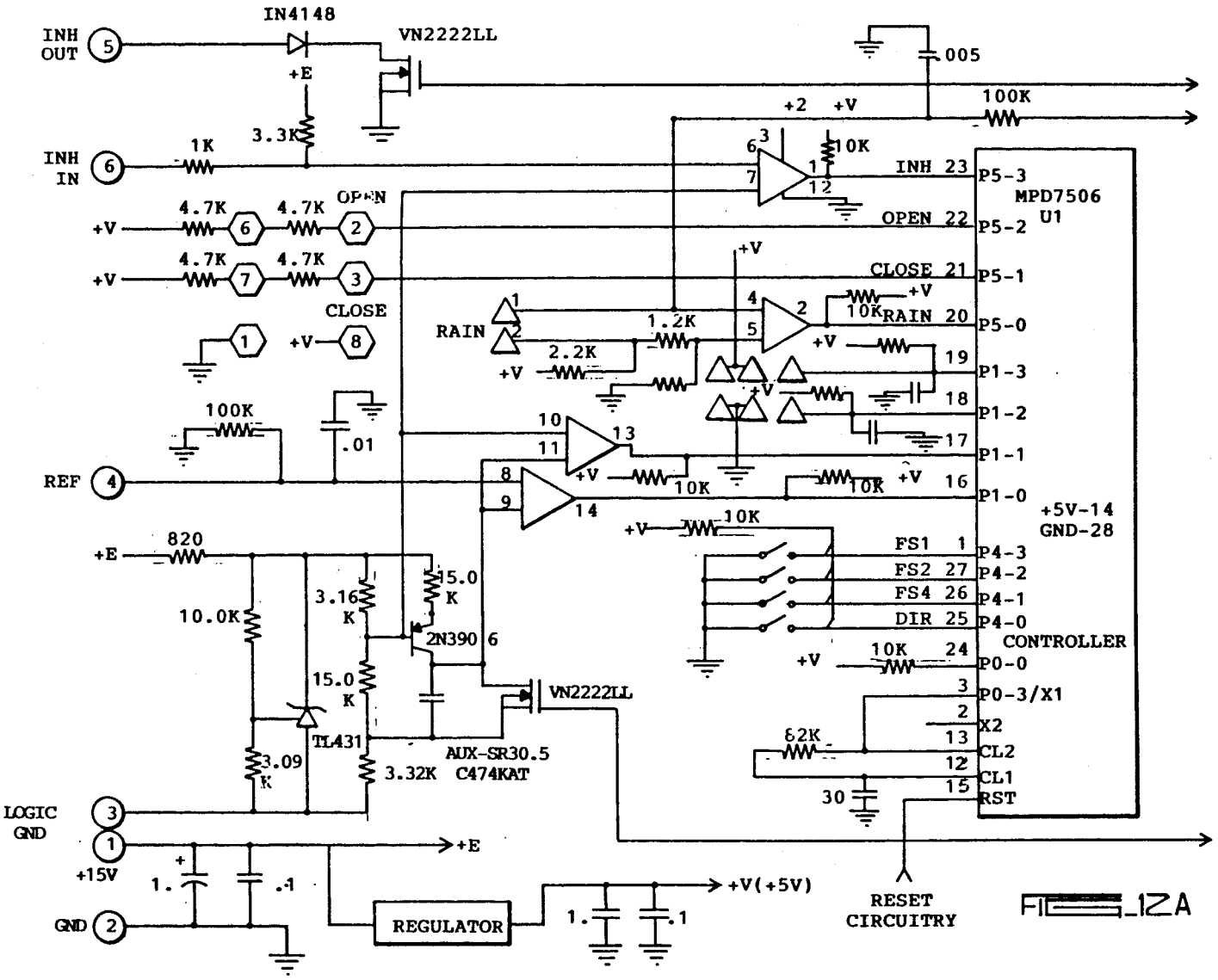
Figure 12B:
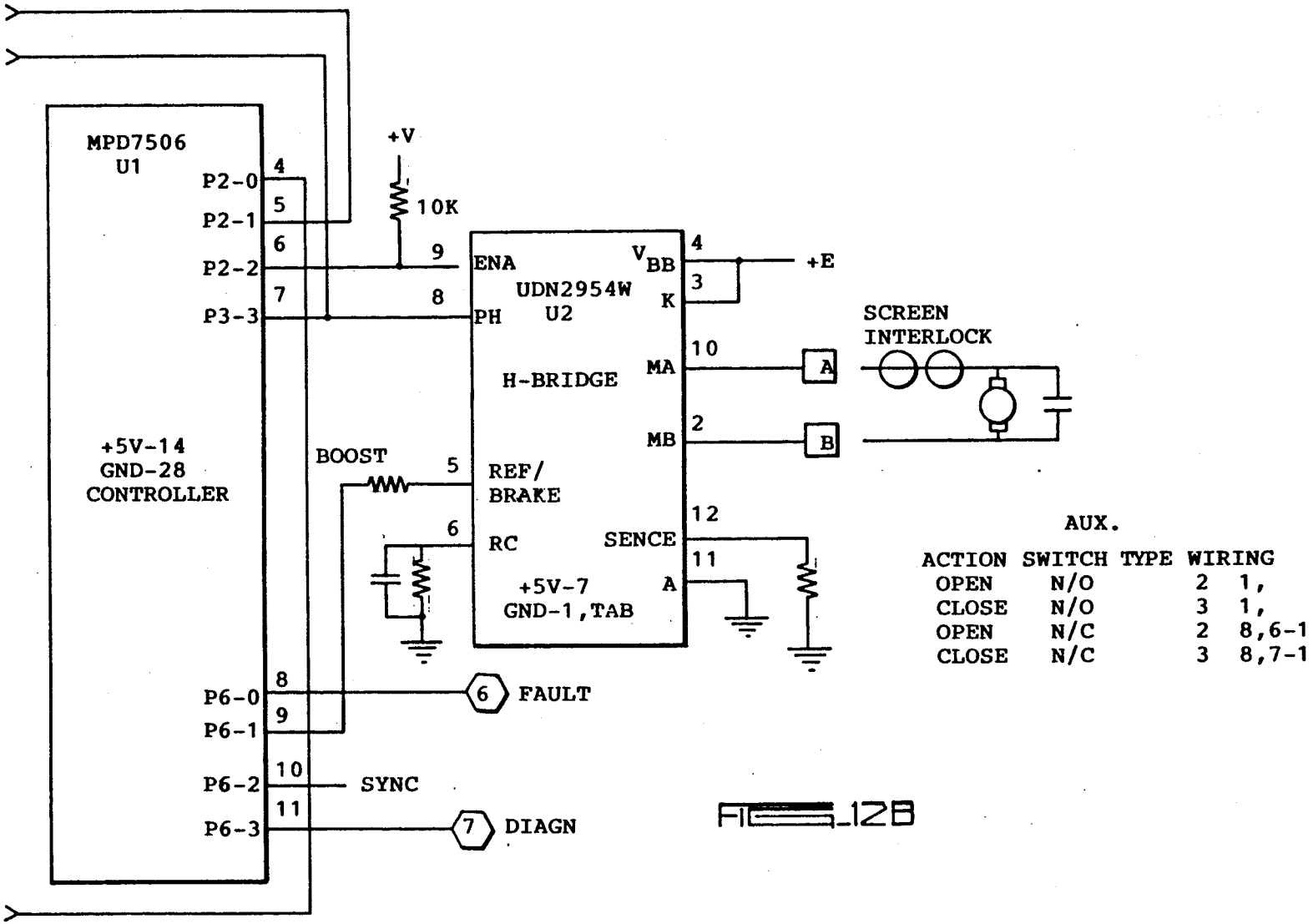

FIG. 12 is a block schematic showing the configuration of the motor 192 for a motorized window operator such as operator 10 or 148. It can be connected to a controller 193 which would consist of electrical circuitry and other components which can issue instructions to motor 192 for appropriate operation. Sensors such as rain sensor 194 can be interfaced with controller 193 to allow autonomous control of the windows according to environmental parameters. There could also be a timer or other activation devices to operate opening and closing the windows.

Power source 195 supplies power to motor 192 through controller 193. By changing the window operator from its locked-in position for electrical motorized window operation, to its manual mode, power is shut off to motor 192. However, the power is still allowed to controller 193 and motor 192. This allows them to still be active to do such things as to monitor the position of the window, even if manually opened or closed, or to provide other monitoring even though in manual mode.

It is therefore submitted that the invention meets at least all of its stated objectives. The preferred embodiment of the invention has been described as has the basic operation. To install the invention, first, particular mechanical hardware, such a mechanical hardware 12 of FIG. 1, must be known so that the appropriate power base 24 can be selected. An appropriate engagement member, such as engagement member 58 shown in FIGS. 4 and 5 must then be selected for a particular rotary spindle or axle of the mechanical hardware of the window. By installing the motorized window operator onto the rotary spindle of the window and an appropriately constructed power base, motorized window operator can be utilized for powered opening and closing of the window.

For an example of the type of control system which can be utilized with such motorized window operator, reference is again given to co-pending and co-owned U.S. patent application Ser. No. 234, 199, entitled Electrical Power and Control Means and Method, by inventors Kraft, Eberhardt, and Cannon, which has been incorporated by reference. The present invention provides an aesthetically pleasing, non-obtrusive motorized window operator, which can be easily converted into a manual mode. In manual mode, electrical power is cut off from the motor for safety purposes.

It is to be understood that motorized window operators could be operatively mounted on a plurality of windows and controlled from a control switch. Other enhancements are possible.

It is to be further understood and appreciated that the present invention can take many forms and embodiments. The true essence and spirit of this invention are defined in the appended claims, and it is not intended that the embodiment of the invention presented herein should limit the scope thereof. Other means may suggest themselves to those skilled in the art. For example, instead of the conventional spur gears used in the epicyclic gear train described above, the invention could work with worm gears, beveled gear sets and other types of rotational-movement-to-rotational-movement translation and still stay within the boundaries of the invention.

What is claimed is:

1. A motorized window operator for opening and closing a window having a mechanical drive system including a rotatable drive axle comprising:

a housing means which is both translatable and rotatable with respect to an engagement means;

motor means having an output shaft rotatable in opposite directions contained within the housing means;

the engagement means engaging the rotatable drive axle of the window;

gear means for transferring rotational movement of the output shaft of the motor means through the engagement means to the drive axle of the window;

translation means for moving the gear means between a first position in operative engagement with the engagement means, and a second position out of operative engagement with the engagement means; and mating means mateable and engageable with the engagement means when the gear means is in the second position and allowing manual rotation of the drive axle by manual rotation of the housing means.

2. The operator of claim 1 wherein the gear means comprises a gear train of epicyclic gears for converting high speed, high torque rotation of the output shaft of the motor to high torque, low speed rotation at the gear train output gear.

3. The operator of claim 2 wherein the output gear comprises a conventional spur gear.

4. The operator of claim 1 wherein the gear means comprises beveled gears, and the engagement means includes a beveled gear.

5. The operator of claim 1 wherein the gear means further comprises a non-rotational extended means including a tooth which is engagable with the engagement means when the gear means is in the second position.

6. The operator of claim 1 further comprising pivot means for allowing pivoting of the housing between the first and second positions.

7. The operator of claim 6 wherein the pivot means allows both pivoting to disengage the gear means, and rotational pivoting around the axis of the drive axle of the mechanical drive system of the window.

8. The operator of claim 7 wherein when the tooth engages the engagement means, pivoting of the housing causes concurrent rotation of the engagement means and rotatable drive axle to allow manual operation of the window.

9. The operator of claim 8 wherein the gear means can be releasably locked into the second position.

10. The operator of claim 1 further comprising a power base means mounted to the window, the housing being releasably engageable with the power base means, the power base means including an electrical power conduit which is engageable with power reception contacts in the housing.

11. The operator of claim 10 wherein power is supplied to the housing when the gear means is in the first position, and power is cut off to the housing when the gear means is in the second position.

12. The operator of claim 10 wherein the housing is elongated in shape having a first end containing the engagement means, and a second end containing a latching means for releasable securing to the power base means.

13. The operator of claim 1 wherein the engagement means comprises a collar means for extending over the rotatable drive axle of the mechanical drive system of the window, and locking means for securing the collar means to the rotatable drive axle so that rotation of the engagement means cause rotation of the drive axle.

14. The operator of claim 13 wherein the engagement means further comprises a collar means which contains magnet means for allowing sensing of rotations of the rotatable drive axle by magnetic sensing means.

15. The operator of claim 1 further comprising sensing means for sensing one or more environmental factors which generates a signal for automatically actuating the operator.

16. A method of motorizing window operation for opening and closing a window having a mechanical drive system including a rotatable drive axle comprising:

connecting an engagement means to the rotatable drive axle;

simultaneously supplying electrical power to a motor means and engaging by translatable movement to the first position a gear train connected from an output shaft of the motor means to the engagement means;

operating the motor to rotate the gear means which turns the engagement means and drive axle, opening or closing the window according to desire;

disengaging the gear means from the engagement means by translatable movement to the second position simultaneously disengaging electrical power from the motor means and engaging the mating means for manually rotating the drive axle by manual rotation of the mating means and engagement means.

17. The method of claim 16 further comprising the step of engaging a lock-up means with the engagement means when the gear means is dissengaged from the engagement means, pivoting the lock up means around the axis of the drive axle to manual turn the drive axle.

18. The method of claim 16 comprising the further step of sensing the position of the drive axle including number of rotations and direction of rotations and correlating the same with position of the window.

19. The method of claim 16 further comprising the step of sensing environmental factors and generating a signal used in opening or closing the window according to desire.

* * * * *